United States Patent [19]

Gatsis

[11] Patent Number: 4,476,012

[45] Date of Patent: Oct. 9, 1984

[54] PROCESS FOR DEASHING PRIMARY COAL LIQUIDS

[75] Inventor: John G. Gatsis, Des Plaines, Ill.

[73] Assignee: UOP Inc., Des Plaines, Ill.

[21] Appl. No.: 433,176

[22] Filed: Oct. 6, 1982

Related U.S. Application Data

[63] Continuation-in-part of Ser. No. 259,295, Apr. 30, 1981, abandoned, which is a continuation-in-part of Ser. No. 89,838, Oct. 31, 1979, abandoned.

[51] Int. Cl.[3] ..... C10G 1/04; C10G 21/00

[52] U.S. Cl. ..... 208/251 R; 208/8 LE; 44/50; 44/51; 44/56; 44/1 A; 44/1 B

[58] Field of Search ..... 208/8 LE, 251 R, 177; 44/50, 51, 56, 1 A, 1 B

[56] References Cited

U.S. PATENT DOCUMENTS

| | | | |
|---|---|---|---|
| Re. 25,770 | 4/1965 | Johanson | 208/10 |
| 3,184,401 | 5/1965 | Gorin | 208/8 |
| 3,321,393 | 5/1967 | Schuman et al. | 208/10 |
| 3,338,820 | 8/1967 | Wolk et al. | 208/108 |
| 3,642,608 | 2/1972 | Roach et al. | 208/8 |
| 4,012,314 | 3/1977 | Goldberger et al. | 208/251 R |
| 4,028,219 | 6/1977 | Baldwin et al. | 208/251 R |
| 4,162,964 | 7/1979 | Leonard | 208/177 |
| 4,192,653 | 3/1980 | Giannetti et al. | 44/51 |
| 4,225,420 | 9/1980 | Rhodes | 208/177 |
| 4,312,747 | 1/1982 | Gatsis | 208/177 |

FOREIGN PATENT DOCUMENTS

| | | | |
|---|---|---|---|
| 2036790 | 7/1980 | United Kingdom | 208/177 |

*Primary Examiner*—Delbert E. Gantz
*Assistant Examiner*—Helane E. Maull
*Attorney, Agent, or Firm*—James R. Hoatson, Jr.; John G. Cutts, Jr.; William H. Page, II

[57] ABSTRACT

A process for deashing primary coal liquids with a selective hydrocarbon solvent separation wherein the coal liquids and selective hydrocarbon solvent are contacted initially at a temperature greater than the temperature at which the deashing separation occurs. More particularly, a process for the production of deashed coal liquid which comprises the sequential steps of: (a) admixing a primary coal liquid containing ash and a hydrocarbon deashing solvent having no hydrogen-transferring ability at a selected admixing temperature from about 250° F. to about 575° F.; (b) reducing the temperature of the entire resulting admixture of the primary coal liquid and hydrocarbon deashing solvent to a deashing temperature about 50° F. to about 125° F. less than the admixing temperature of step (a); and deashing the primary coal liquid with the deashing solvent at the deashing temperature of step (b).

6 Claims, No Drawings

PROCESS FOR DEASHING PRIMARY COAL LIQUIDS

CROSS-REFERENCE TO RELATED APPLICATIONS

This application is a continuation-in-part of my copending application Ser. No. 259,295, which was filed on Apr. 30, 1981 and now abandoned, which in turn is a continuation-in-part of application Ser. No. 89,838 which was filed on Oct. 31, 1979 and now abandoned. These earlier applications are incorporated herein by reference.

BACKGROUND OF THE INVENTION

This invention relates to a process of deashing primary coal liquids obtained from the liquefaction of coal or pyrolysis of coal with a selective hydrocarbon deashing solvent separation whereby the coal liquids and selective hydrocarbon deashing solvent are contacted initially at a temperature greater than the temperature at which the deashing separation occurs. After the coal liquid is deashed to a very low level with high recovery, the coal liquid may then be upgraded into more valuable products via conventional processing techniques.

DESCRIPTION OF THE PRIOR ART

The art is replete with processes for converting solid hydrocarbonaceous materials, such as coal, to mixtures of gaseous and liquid products. The following examples are representative of the many such processes. The Synthoil process, developed at the U.S. Bureau of Mines and described by Yavorsky et al in Chem. Eng. Progress, 69, (3), 51–2 (1973), the H-Coal process, developed by Hydrocarbon Research, Inc. and described in a series of patents including Johanson, U.S. Pat. No. Re 25,770, Schuman et al, U.S. Pat. No. 3,321,393 and Wolk et al., U.S. Pat. No. 3,338,820, and the Solvent-Refined Coal (SRC) process I and II developed by the Gulf Mineral Resources Co. and described in "Recycle SRC Processing for Liquid and Solid Fuels", presented at 4th Int. Conf. on Coal Gasification, Liquefaction and Conversion to Electricity, Univ. of Pittsburgh (Aug. 2–4, 1977), are representative. The Synthoil and H-Coal processes are generally characterized by a fixed or ebullated catalyst bed.

In U.S. Pat. No. 3,184,401 (Gorin), a process is claimed wherein coal extract is subjected to treatment with an aqueous deashing reagent in admixture with a hydrogen-transferring hydrocarbonaceous liquid (coal solvent) at a temperature above 482° F. but not above the temperature at which the coal was subjected to solvent extraction. The '401 (Gorin) patent teaches that the mixture of coal extract, coal solvent and residue are contacted with aqueous hydrochloric acid in a deashing zone without substantial cooling wherein the residue is separated from the coal extract and coal solvent. This same patent makes an oblique reference to a then-copending application which allegedly teaches that if a coal extract is deashed with a relatively dilute aqueous reagent, it is necessary to pre-cool the extract below the critical point of water, i.e., 707° F. Since the present invention does not teach the use of any aqueous solutions and since washing with aqueous acid solutions is not considered solvent separation as that term is customarily understood in the coal deashing art, it is believed that the present invention clearly distinguishes the prior art U.S. Pat. No. 3,184,401 (Gorin). Additionally the Gorin patent fails to mention or teach the admixture of a hydrocarbon deashing solvent having no hydrogen-transferring ability together with a primary coal liquid which admixture is a critical step of the present invention.

U.S. Pat. No. 3,184,401 (Gorin) also discusses economically prohibitive coal extract deashing methods taught by the prior art which involve deashing coal extract at a relatively low temperature, generally below 212° F. This patent further mentions that since the solvent extraction and catalytic hydrogenation zones are usually operated at a temperature of at least 482° F. and normally 662° F. to 842° F., the extract must thus be cooled from the relatively high extraction temperature to the relatively low deashing temperature; deashed; and then reheated to the hydrogenation temperature. The Gorin patent then offers the solution to the above mentioned disadvantages of the prior art, viz., deashing without any cooling and reheating. It is important to note that this prior art merely acknowledges that extract (coal), and only extract, is cooled from extraction temperatures to deashing temperatures. Nowhere does this prior art discussion teach or suggest that coal extract together with a deashing solvent be cooled to deashing temperature. The discovery of the advantange of cooling both coal extract and the deashing solvent is the keystone of the present invention.

In U.S. Pat. No. 4,225,420 (Rhodes), a deashing process is described wherein coal extract is admixed with a deashing solvent at a temperature level from about 400° F. to about 700° F. and this feed admixture is continuously introduced into a deashing zone to yield a light phase and a heavy phase. Sometime after the initiation of a heavy phase withdrawal, the temperature level within the deashing zone is gradually lowered while the feed admixture introduction and heavy phase withdrawal are continued. It is believed that the Rhodes patent does not disclose or teach the sequential steps of admixing a coal extract and a deashing solvent, reducing the temperature of the entire resulting admixture of coal extract and deashing solvent and subsequently deashing the cooled admixture.

U.S. Pat. No. 3,642,608 (Roach et al) claims a process for the solvent extraction of coal with a highly aromatic hydrocarbon petroleum refinery byproduct stream and the separation of the insoluble material from the solution of solubilized coal. The separation or deashing by the patentee does not utilize the addition of a selective hydrocarbon deashing solvent after the acquisition or formation of coal extract and does not intentionally cool the coal extract until after two separate stages of ash removal have been performed.

U.S. Pat. No. 4,192,653 (Giannetti et al) teaches a method for producing a novel composition which is derived from coal wherein the coal is extracted with a solvent and the resulting coal extract, without the addition of a selective hydrocarbon deashing solvent, is simply deashed. The preferred deashing is performed by a solid-liquid deashing step, viz., filtration. The patentee does not appreciate or teach the deashing benefits provided by the addition of a selective hydrocarbon deashing solvent, subsequent temperature adjustments which yield increased quantities of deashed coal extract or a liquid-liquid deashing step.

BRIEF SUMMARY OF THE INVENTION

The present invention is, in one embodiment, a process for the production of deashed coal liquid which comprises the sequential steps of: (a) admixing a primary coal liquid containing ash and a hydrocarbon deashing solvent having no hydrogen-transferring ability at a selected admixing temperature from about 250° F. to about 575° F.; (b) reducing the temperature of the entire resulting admixture of the primary coal liquid and hydrocarbon deashing solvent to a deashing temperature about 50° F. to about 125° F. less than the admixing temperature of step (a); and (c) deashing the primary coal liquid with the deashing solvent at the deashing temperature of step (b).

Other embodiments of the present invention encompass further details such as preferred feedstocks, deashing solvents and operating conditions, all of which are hereinafter disclosed in the following discussion of each of these facets of the invention.

DETAILED DESCRIPTION OF THE PRESENT INVENTION

Recently, high pressure hydrogenation and coal liquefaction techniques have been developed. In the process of coal liquefaction known to the prior art, crushed, finely-divided particulate coal is placed in contact with a liquid solvent which dissolves a part of the solid, usually in the presence of hydrogen gas. Following the contact, the liquid solvent and the liquefied part of the solid are separated from the remaining solid material by filtration, centrifuging or a similar operation.

One of the problems encountered in the solvent extraction method of liquefying coal has been the inability to recover the maximum quantity of coal extract while minimizing the ash content of the coal extract in order to permit subsequent conventional hydrocarbon processing techniques. A portion of this problem is that hydrocarbons adhere to and are adsorbed in the solids or ash and another portion of this problem is the difficulty of finally separating the liquid hydrocarbons from the ash. Yet another problem is the presence of substances such as coal-derived carbenes which are generally not in solution in the liquefied coal slurry at temperatures below about 400° F. Thus the recovery of the maximum quantity of coal extract while minimizing the ash content of the coal extract is a desirable goal.

Another source of primary coal liquids which may be processed according to the method of this invention is the pyrolysis of coal. In the production of more highly refined hydrocarbonaceous products from coal pyrolysis liquids, it is also important to recover the maximum quantity of hydrocarbons while minimizing the ash content in order to permit subsequent conventional hydrocarbon processing techniques.

Primary coal liquids are defined as the hydrocarbons which are derived from the liquefaction or pyrolysis of coal. The process of the present invention is an improved method for the separation of primary coal liquids from ash. In addition to ash, the primary coal liquids which are suitable for my process may also contain coal liquefaction solvent and finely-divided unconverted coal.

In the present process wherein primary coal liquids are deashed by means of a selective hydrocarbon deashing solvent separation, it has been found that more deashed coal liquids having better quality may be recovered from the primary coal liquids by sequentially admixing the coal liquids and deashing solvent at a temperature from about 250° F. to about 575° F., subsequently cooling the entire coal liquids and hydrocarbon deashing solvent mixture to a deashing temperature about 50° F. to about 125° F. less than said admixing temperature and then deashing the primary coal liquid with the deashing solvent at the selected deashing temperature. Deashing is performed by permitting an admixture of primary coal extract and a suitable deashing solvent to attain a state of quiescence and then withdrawing an upper phase which is solvent-rich and ashless, and a lower solvent-lean phase containing ash. Not wishing to be bound by any theory or explanation, by performing the above mentioned procedure in accordance with the present invention, it is believed that the coal liquid hydrocarbons which remain in close association with the ash are dissolved, solubilized and recovered. The hydrocarbons which readily associate with the ash generally have a relatively high molecular weight and also a high melting point. Therefore, in order to successfully recover these high melting point hydrocarbons, a deashing solvent must be present at an elevated temperature so that as the hydrocarbons are melted, they become disengaged from the ash and solubilized in the deashing solvent. It is essential that a stable solution of these high boiling hydrocarbons be formed in order to minimize the amount of these hydrocarbons from being separated with the solvent-lean heavy phase in the deashing step which would vitiate the purpose of the present invention. The yield of ash-free hydrocarbons in the deashing step is thereby maximized compared with admixing and deashing at the same temperature as shown herein below in Table III. Previously, the prior art was unable to maximize the recovery of high quality liquid hydrocarbons because those skilled in the art did not possess the knowledge or have access to any teachings which would disclose or suggest the process of the present invention or the advantages thereof. The present invention, in contradistinction with U.S. Pat. No. 3,184,401 (Gorin), teaches the admixing of a primary coal liquid containing ash with a hydrocarbon deashing solvent having no hydrogen-transferring ability at a selected admixing temperature from about 250° F. to about 575° F. and then reducing the temperature of the resulting admixture of the primary coal liquid and hydrocarbon deashing solvent to a deashing temperature which is 50° F. to 125° F. less than the admixing temperature. The present invention, in contradistinction with U.S. Pat. No. 4,225,420 (Rhodes), which discloses the initiation of deashing before cooling claims a process for the production of deashed coal liquid which comprises the sequential steps of admixing a primary coal liquid containing ash and a hydrocarbon deashing solvent having no hydrogen-transferring ability at a selected admixing temperature from about 250° F. to about 575° F.; reducing the temperature of the entire resulting admixture of said primary coal liquid and hydrocarbon deashing solvent to a deashing temperature about 50° F. to about 125° F. less than the admixing temperature; and deashing the primary coal liquid with the deashing solvent at the selected deashing temperature. For purposes of this discussion, a hydrocarbon is said to possess a hydrogen-transferring ability when the hydrocarbon can readily perform an intermolecular hydrogen transfer to a primary coal liquid. The prior art teaches that the most active and preferred type of hydrogen transfer hydrocarbons are partially hydrogenated polycyclic hydrocarbons which boil at temperatures above about 392° F. In general, those hydrocarbons which possess hydrogen transferring ability have a relatively high molecular weight and also a high boiling point, and demonstrate inferior ability to act as suitable deashing solvents at the preferred conditions of the present invention. Additionally, hydrocarbons having hydrogen-transfer ability are more difficult to separate from the deashed coal liquid because of the similarities of their respective boiling points or boiling ranges.

The solid carbonaceous material utilized to produce coal extract or coal liquids which is subsequently utilized in the process of this invention may be any type of coal. Any selected coal which has been subjected to liquefaction may act as a source for the coal extract which is utilized in the process of the invention.

Suitable hydrocarbon deashing solvents include those selected from the group of light hydrocarbons including ethane, methane, propane, butane, isobutane, pentane, isopentane, neopentane, hexane, isohexane, heptane, the mono-olefinic counterparts thereof, aromatic compounds including benzene and toluene, naphtha boiling range hydrocarbons, etc. In no event, shall the hydrocarbon deashing solvent demonstrate hydrogen-transferring ability at the preferred operating conditions of the present invention. Furthermore, the deashing solvent may be a normally liquid naphtha fraction containing hydrocarbons having from about 5 to about 14 carbon atoms per molecule, and preferably a naphtha distillate having an end boiling point below about 350° F. A preferred deashing solvent in a $C_3$–$C_7$ alkane or a mixture of two or more of such alkanes. For example, suitable deashing solvent mixtures will comprise normal butane and isopentane, propane and normal butane, normal butane and normal pentane, etc. Regardless of the type of hydrocarbon deashing solvent selected, the selected deashing solvent must not demonstrate any hydrogen-transferring ability in accordance with the teachings of the present invention.

According to the present invention, the admixture of the primary coal liquid containing ash and a hydrocarbon deashing solvent having no hydrogen-transferring ability is conducted at a temperature from about 250° F. to about 575° F. Once the desired admixing temperature is selected, a judicious choice of admixing pressure will ensure that the admixing will be conducted in liquid phase. As a matter of fact, all of the steps of the present invention are preferably conducted in liquid phase. An admixture pressure is preferably from about 10 to about 1000 psig. The hydrocarbon deashing solvent to coal extract volumetric ratio is preferably in the range of about 1:1 to about 30:1 and more preferably from about 3:1 to about 10:1. The selection of deashing solvent ratios is partially determined by the quantity, if any, of coal liquefaction solvent present together with the coal extract.

In order to enjoy the full benefits of the present invention, the entire admixture of primary coal liquid and hydrocarbon deashing solvent must be reduced in temperature by about 50° F. to about 125° F. below the admixture temperature. Again, this temperature reduction step is preferably performed in liquid phase at a pressure from about 10 to about 1000 psig. After the entire admixture of coal extract and hydrocarbon deashing solvent has been cooled as taught hereinabove, deashing of the cooled admixture is conducted at a pressure from about 10 to about 1000 psig.

Operating conditions during the mixing, heating and extraction (deashing) operations will be selected according to the characteristics of the primary coal liquid, of the coal liquefaction solvent, the selected hydrocarbon deashing solvent and the desired product quality. Regardless of the operating conditions which are selected, it is critical to the operation of this invention that the primary coal liquid and selective hydrocarbon deashing solvent be initially admixed at a temperature greater than that temperature selected for the subsequent separation or deashing step.

The following examples are presented in illustration of my invention. In presenting these examples, it is not intended that the invention be limited to the specific illustrations, nor is it intended that a given process be limited to the particular operating conditions, hydrocarbon deashing solvent, coal liquids, processing techniques, etc. It is understood, therefore, that the present invention is merely illustrated by the specifics hereinafter set forth.

EXAMPLE I

In this example, a typical primary coal liquid obtained from coal liquefaction having the properties presented in Table I, was utilized in three separate deashing runs with a hexane deashing solvent. Each of these runs was performed at a pressure of 400 psig, a selective hydrocarbon deashing solvent to primary coal liquid ratio, volume basis, of 4, and a residence time of 50 minutes. Each successive run was, however, conducted at a different separation or deashing temperature, viz., 266°, 313°, and 335° F. The yield of deasphalted coal extract increased as the separation or deashing zone temperature increased and was 67.8, 70.2 and 75.0 weight percent, respectively. These results are presented in Table II.

TABLE I

| COAL EXTRACT PROPERTIES | |
|---|---|
| GRAVITY, °API @ 60° F. | −5.7 |
| Distillation (ASTM D-1160) | |
| IBP, °F. | 395 |
| 10% | 510 |
| 30% | 642 |
| 50% | 762 |
| 70% | 945 |
| % OVER | 70.0 |
| % BOTTOM | 30.0 |
| HEPTANE INSOLUBLE, WT. % | 19.0 |
| BENZENE INSOLUBLE, WT. % | 6.3 |
| ASH (ASTM), WT. % | 1.4 |

TABLE II

| COAL EXTRACT DEASHING | SOLVENT | | |
|---|---|---|---|
| | HEXANE | HEXANE | HEXANE |
| TEMPERATURE, °F. | 266 | 313 | 325 |
| PRESSURE, PSIG | 400 | 400 | 400 |
| SOLVENT/OIL RATIO (VOLUME) | 4 | 4 | 4 |
| RESIDENCE TIME, MINUTES | 50 | 50 | 50 |

TABLE II-continued

| COAL EXTRACT DEASHING | SOLVENT | | |
|---|---|---|---|
| | HEXANE | HEXANE | HEXANE |
| DEASPHALTED OIL YIELD, WT. % | 67.8 | 70.2 | 75.0 |
| ASH, WT. % | <0.001 | <0.002 | <0.001 |

EXAMPLE II

A portion of the primary coal liquids having the properties described in Table I was deashed with a hexane deashing solvent at a pressure of 590 psig, a deashing solvent to coal liquid ratio, volume basis, of 4, and a residence time of 45 minutes with a separation temperature of 329° F. The resulting deashed oil represented 74.1 weight percent of the coal liquids feed and contained less than 0.001 weight percent ash. These results are summarized in Table III.

EXAMPLE III

This example is an illustration of the process of the present invention. A portion of the primary coal liquids having the properties described in Table I was admixed with a hexane deashing solvent at a temperature of 428° F. and then deashed at a pressure of 590 psig, a deashing solvent to coal liquid ratio, volume basis, of 4, and a residence time of 45 minutes with a separation temperature of 329° F. The resulting deashed oil represented 85.4 weight percent of the coal liquids feed and contained less than 0.001 weight percent ash. These results are also summarized in Table III.

TABLE III

| COAL EXTRACT DEASHING COMPARISON | EXAMPLE II | EXAMPLE III |
|---|---|---|
| | SOLVENT | |
| | HEXANE | HEXANE |
| MIXER TEMPERATURE, °F. | — | 428 |
| SEPARATION TEMPERATURE, °F. | 329 | 329 |
| SEPARATION PRESSURE, PSIG | 590 | 590 |
| SOLVENT/OIL RATIO (VOLUME) | 4 | 4 |
| RESIDENCE TIME, MINUTES | 45 | 45 |
| DEASPHALTED OIL YIELD, WT. % | 74.1 | 85.4 |
| ASH, WT. % | 0.001 | 0.001 |

The foregoing specification and examples clearly illustrate the improvements encompassed by the present invention and the benefits to be afforded a process for deashing primary coal liquids.

We claim:

1. A process for the production of deashed coal liquid which comprises the sequential steps of:
   (a) admixing a primary coal liquid containing ash and a hydrocarbon deashing solvent having no hydrogen-transferring ability at a selected admixing temperature from about 250° F. to about 575° F.;
   (b) reducing the temperature before deashing of the entire resulting admixture of said primary coal liquid and hydrocarbon deashing solvent to a deashing temperature about 50° F. to about 125° F. less than said admixing temperature of step (a);
   (c) deashing said primary coal liquid with said deashing solvent at said deashing temperature of step (b).

2. The process of claim 1 wherein said hydrocarbon deashing solvent is hexane.

3. The process of claim 1 wherein said hydrocarbon deashing solvent is toluene.

4. The process of claim 1 wherein said hydrocarbon deashing solvent is a mixture of toluene and hexane.

5. The process of claim 1 wherein said deashing is performed at a pressure from about 10 to about 1000 psig.

6. The process of claim 1 wherein said deashing is performed with a hydrocarbon deashing solvent to coal liquid volume ratio of from about 1:1 to about 30:1.

* * * * *